United States Patent [19]

Benya

[11] 4,015,798

[45] Apr. 5, 1977

[54] FLEET ANGLE SYSTEM AND METHOD OF LEVEL WINDING

[75] Inventor: John S. Benya, San Diego, Calif.

[73] Assignee: The United States of America as represented by the Secretary of the Navy, Washington, D.C.

[22] Filed: Feb. 17, 1976

[21] Appl. No.: 658,639

[52] U.S. Cl. ..... 242/157.1; 242/158.3

[51] Int. Cl.[2] ..... B65H 54/28

[58] Field of Search ..... 242/157.1, 158 R, 158.2, 242/158.3, 158.4 R, 158.5; 254/190 R

[56] References Cited

UNITED STATES PATENTS

| | | | |
|---|---|---|---|
| 3,589,642 | 6/1971 | Blagg | 242/157.1 |
| 3,809,334 | 5/1974 | Beurer et al. | 242/158.3 |
| 3,966,171 | 6/1976 | Hale | 242/157.1 X |

FOREIGN PATENTS OR APPLICATIONS

| | | | |
|---|---|---|---|
| 1,330,280 | 5/1962 | France | 242/157.1 |

*Primary Examiner*—Stanley N. Gilreath
*Attorney, Agent, or Firm*—Richard S. Sciascia; Ervin F. Johnston; Thomas Glenn Keough

[57] ABSTRACT

A pivoted frame assembly is guided back and forth across a winch drum by an interconnected double diamond lead screw. Sheaves journaled on a frame assembly feed the cable or a hydrophone array in a manner so as not to create crushing stresses on the cable or side load forces during deployment and retrieval. Because of the physical disposition of the framework and sheaves with respect to the winch drum and their mechanical coaction with other related structural elements, the fleeting sheave is closer than contemporary units so that the overall structure is more compact.

5 Claims, 4 Drawing Figures

FIG. 1.
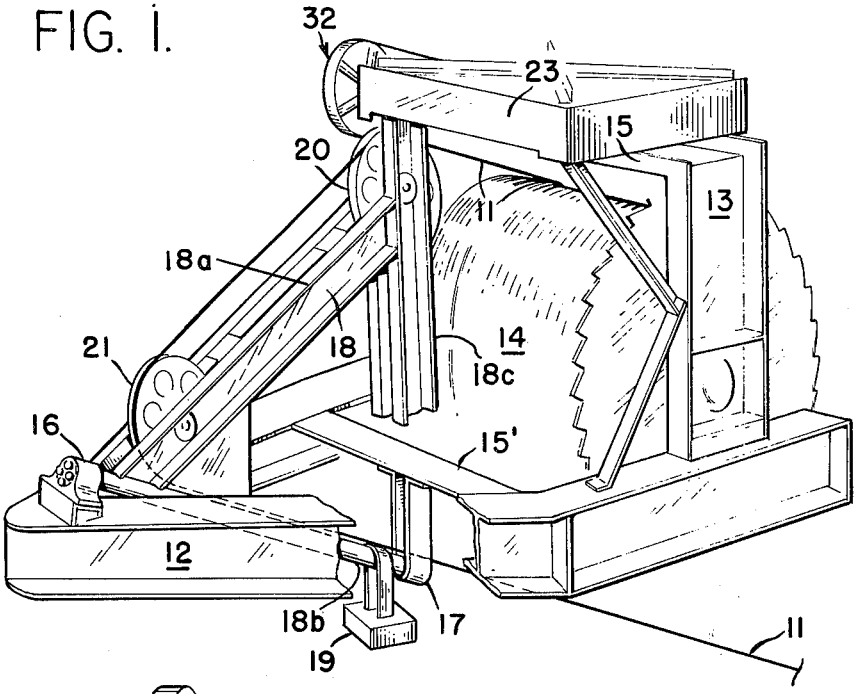
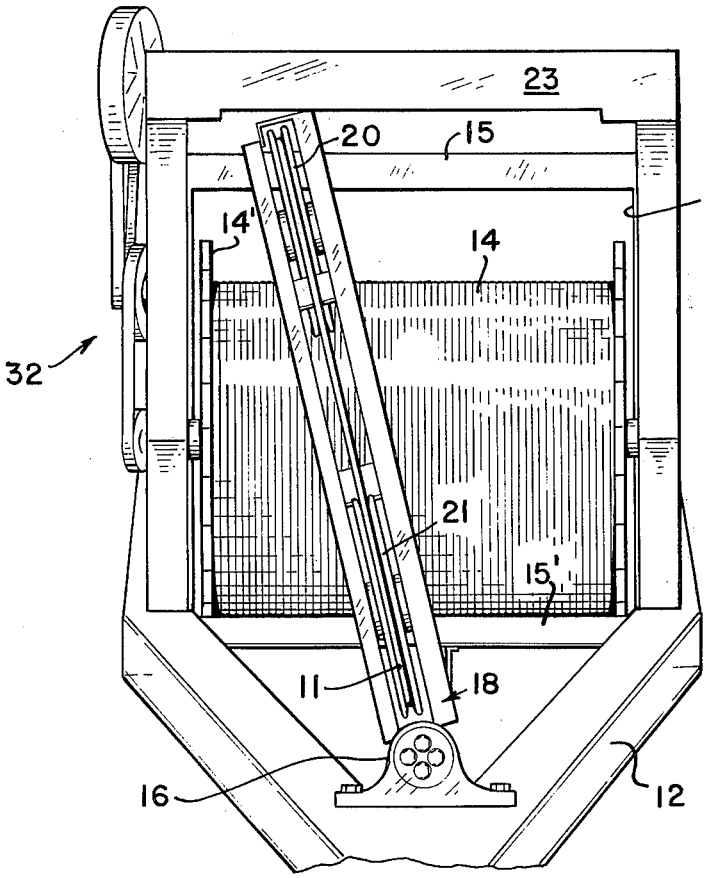
FIG. 2.

FLEET ANGLE SYSTEM AND METHOD OF LEVEL WINDING

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

For years cables have been used to tow instrumentation packages or hydrophone arrays behind a surface or undersea craft. While a variety of storage and deployment schemes have been tried, one of the most popular is to store the cable or array on a drum. Rotating the drum in one direction plays out the cable or array while rotating the drum in the opposite direction reels it in. As seismic explorations and military applications have imposed increased demands on the towing cables and the elongate hydrophone arrays, the stresses and sensitivities and, consequently, susceptibility to damage has increased accordingly. Care must be taken to hold stresses to a minimum. Among these stresses to be avoided are those forces acting on a cable as it extends between the ends of a winch drum and a fleeting sheave. Usually the winch drum is mounted at a relatively protected location on the deck or in a compartment and the cable is fed out through a fleeting sheave. Experience has demonstrated that the fleeting angle (the ratio of the distance from the winch drum to the fleeting sheave divided by the winch drum width) is a limiting factor to avoid the creation of excessive side forces on the cable and to allow proper level winding. When the fleeting distance/drum width is less than five-to-one, the unduly large side forces can damage the cable in a level wide system. The spacing needed to attain the five-to-one ratio is a luxury that cannot be afforded in some compact surface and undersea research vessels. There is, therefore, a continuing need in the state of the art for a cable deployment and retrieval apparatus which provides for a smaller fleeting angle to achieve reduction of stresses on the cable and which also reduces the in side loading in the level wind system.

SUMMARY OF THE INVENTION

The pesent invention is directed to providing an apparatus for level winding a cable on a winch drum which avoids the creation of undue stresses. The winch drum is journaled in a heavy duty supporting means which carries a pivoting means having a pivot axis disposed so that and extension of the pivoting means is moved to traverse the width of the drum. Orienting means carried on the pivoting means directs the cable where it is played out from the apparatus and where it leaves the winch drum in a substantially parallel relationship to the pivot axis of the pivoting means thereby avoiding the creation of damage producing stresses.

It is an object of the invention to provide an improved apparatus for deploying and retrieving a cable or hydrophone array under widely varying cable tensions.

Yet another object of the invention is to provide a cable or array deployment apparatus that is of reduced size.

Still another object of the invention is to provide a cable or hydrophone deploying device that does not introduce undue stresses.

Still another object is to provide a deployment apparatus guiding its cable or array by sheaves thereby avoiding the creation of crush stresses on a cable jacket.

Still another object is to provide an apparatus for deploying a cable or array which reduces bending stresses on the cable or array.

Yet another object of the invention is to provide an apparatus which minimizes the side load force on the level wind drive system.

Another object of the invention is to provide an apparatus designed to withstand the harsh salt water environment of the ocean and which is insensitive to ambient pressure variations.

Still another object is to provide an apparatus having a design so that the geometry of the cable between th winch drum and upper fleeting sheave is parallel to a fleeting frame pivot axis when the cable is at the lateral extreme of the winch drum near the drum flange at mid layer.

These and other objects of the invention will become more readily apparent from the ensuing description when taken with the drawings.

BRIEF DESCRIPTION OF THE DRAWINGS

FIG. 1 is an isometric depiction of the invention shown partially in cross section to expose the pivoting means and the counterweighting means.

FIG. 2 shows an end view of the invention.

DESCRIPTION OF THE PREFERRED EMBODIMENT

Figure 3:
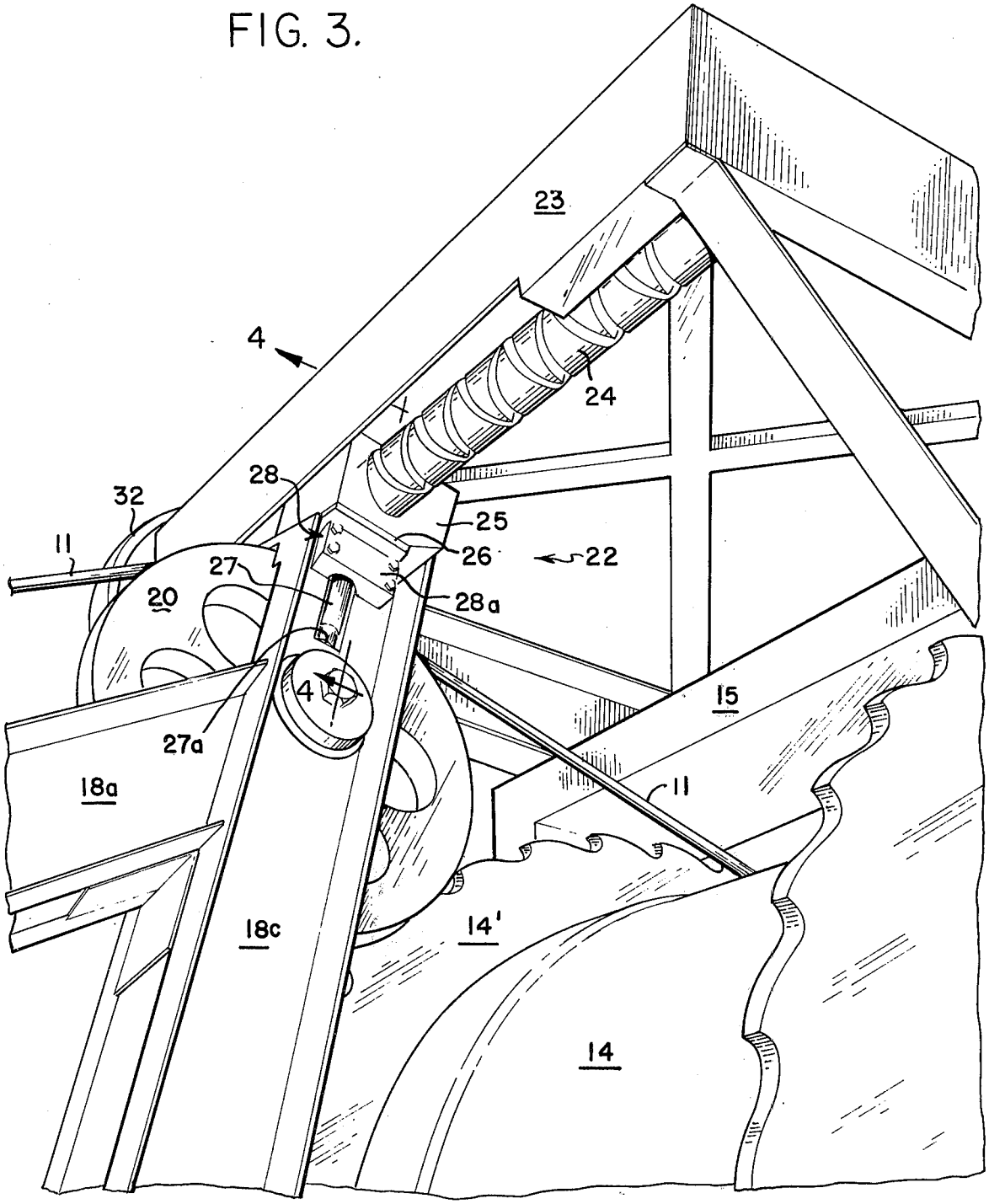
FIG. 3 shows an isometric depiction of a portion of the invention.

Referring to the drawings, there is shown a representative embodiment of a cable deploying apparatus 10 which possesses and demonstrates the inventive concepts of this invention. A cable 11 is wrapped about the apparatus to a depth of several layers.

A heavy duty base member 12 is fashioned from sections of channel or I-beams welded together. Vertical channels 13 extend from the base member and a cylindrically shaped winch drum 14 is journaled between them. Upper and lower cross members 15 and 15' and appropriate bracing are welded between the vertical channels and across the base member to lend structural integrity to the apparatus.

The hydraulic and/or electrical control elements and the mechanism for rotating the winch drum have been deleted from the drawings. Inclusion of such structure would detract from the inventive concept of this invention. It is well known that within the state of the art a routineer would be free to select any of a variety of control and motion imparting mechanisms to deploy cable 11.

A thrust bearing 16 mounted on the top of the base member and a spherical bearing 17 depending from lower cross member 15' provide pivotal support for a triangular bracket shaped fleeting frame assembly 18 made up of three elements **18*a*, 18*b* and 18*c*. The three elements are connected in a triangular configuration and the connection between elements 18*b* and 18*c* is not shown so as not to hide spherical bearing 17**.

The thrust bearing is any one of a number of suitable designs available in the state of the art for providing rotational support for the fleeting frame assembly. It is sufficiently stressed to bear the weight of the assembly and other elements mounted thereon while a spherical bearing 17 mainly functions to provide a rotatable support for the assembly. A counter weight is secured to depend from element 18*b* the fleeting frame assembly to reduce unwanted moments and level wind loads.

A first sheave 20 is journaled between spaced apart channel members of element 18*a* of the fleeting frame assembly. The peripheral groove of the sheave is diminished to receive the cable and not pinch or otherwise abrade it. The cable reaches from the first sheave to a second sheave 21 journaled near thrust bearing 16. From there the cable extends to either a fairlead sheave or directly to a towed instrumentation package located along the pivot axis of fleeting frame assembly 18.

It should be noted that the length of cable reaching from the winch drum to sheave 20 and the length of cable remotely extending from sheave 21 are parallel with one another when cable 11 is at the last wrap next to drum flange 14' at the mid-layer on the drum. In addition, the length of cable extending between sheaves 20 and 21 is co-planar with both the other lengths of cable as well as the pivotal axis of the fleeting frame assembly. This arrangement ensures a minimum of chafing and bending of the cable as it is being deployed or retrieved. This arrangement also provides for a greatly reduced side loading on that length of cable 11 extending between sheave 20, particularly when the cable reaches from an area near winch drum flange 14'.

Level winding of the cable on the winch drum is assured due to the inclusion of a driving mechanism 22 journaled in an overhead frame 23. The principal components of the driving mechanism are a double diamond lead screw 24 and its operatively associated pawl-and-pawl housing 25. The unit selected is a commercially available one marketed by Lebus International Incorporated of Longview, Texas. Its mode of operation and its machining and assembly are well known. Further discussion regarding the driving mechanism is felt to be unwarranted other than it reliably displaces the fleeting frame assembly across the width of the winch drum.

Figure 4:
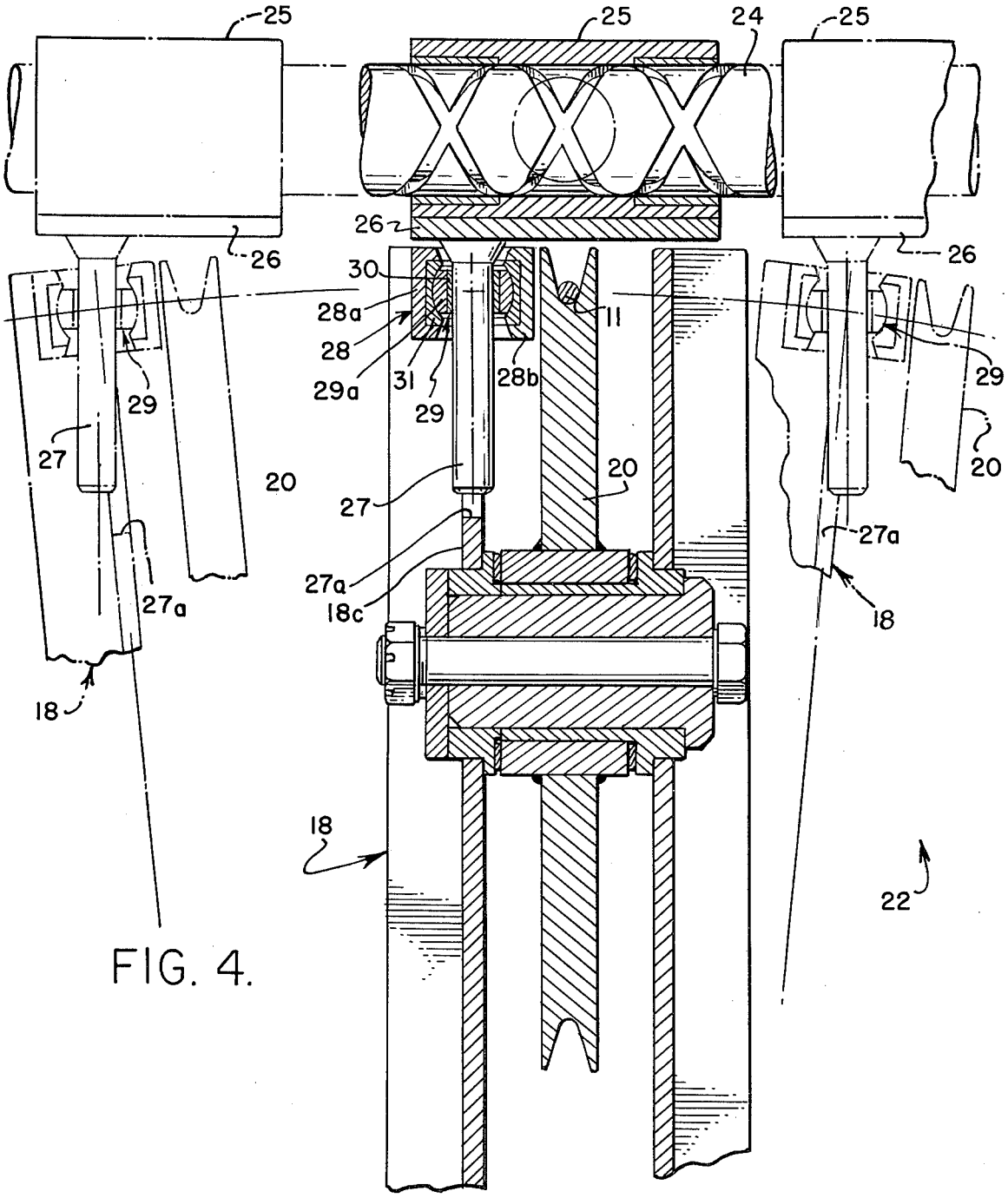
FIG. 4 shows a detail of the invention taken generally along lines 4—4 in FIG. 3.

The possibility of failure of the drive mechanism is reduced greatly by the novel manner and structure coupling the bracket shaped fleeting frame assembly to the mechanism. Noting FIG. 4, a mounting plate 26 is screwed onto pawl housing 25 and has depending from it a drive pin 27. The drive pin is welded or otherwise rigidly affixed to the mounting plate and extends into and through a split housing 28 and into a slot 27*a* cut in the end of element 18*c* of the fleeting frame assembly.

The split housing is bolted onto the outwardmost extension of the fleeting frame assembly and has a first and a second portion 28*a* and 28*b* containing a friction free bearing mechanism 29.

The bearing mechanism is essentially a ball shaped device 29*a* provided with a low friction insert 30 in which the drive pin is capable of limited reciprocal motion and as the fleeting frame assembly 18 is angularly displaced.

The outer surface of the bearing mechanism is retained in a suitably shaped sleeve 31 also having low friction properties. Thusly, the bearing 29 is capable of slight rotational motions as fleeting frame assembly 18 is angularly displaced across the width of the winch drum. Note that the drive pin is coplanarly perpendicular to the pivot axis of the fleeting frame assembly 18 and coplanar to the axis of first sheave 20. This orientation avoids creating any binding which could interfere with the passage of the cable. There are only insignificantly small bending forces transmitted to double diamond lead screw 24 of driving mechanism 22.

The rate at which double diamond lead screw 24 moves fleeting frame assembly across the winch drum is a function of its pitch. However, a timing belt reduction drive 32 coupling the lead screw to the hub of the winch drum ensures that the cable is evenly wound on the drum by adjusting the rate of rotation of the lead screw.

All the aforedescribed elements are fashioned from corrosion resistant or noncorrosive materials to resist the effects of the harsh ocean environment. Protective coatings are applied where needed and lubricants ensure trouble free operation.

Obviously, many modifications and variations of the described inventive concept are possible in the light of the above teachings, and, it is therefore understood the invention may be practiced otherewise than as specifically described.

What is claimed is:

1. An apparatus for level winding several layers of a cable on a winch drum which avoids the creation of undue stresses thereon comprising:

means for supporting the winch drum to permit the winding and unwinding of the cable thereon;

means mounted on the supporting means for pivoting about an axis and having an extension disposed to be pivoted about the pivot axis across the width of the drum;

means carried on the supporting means for moving the extension of the pivoting means across the width of the winch drum;

means connected to the extension of the pivoting means and the moving means for ensuring the travel of the extension across the width of the winch drum, the ensuring means includes a drive pin secured to the moving means and extending toward the extension of the pivoting means, said drive pin has its longitudinal axis coplanar with the axis of the first sheave;

means carried on the pivoting means for orientating the cable where it leaves the winch drum and where it is played out from the apparatus substantially parallel to the pivot axis of the pivoting means, the orientating means includes a first sheave journaled on the extension of the pivoting means adjacent the winch drum and a second sheave journaled on the extension of the pivoting means adjacent the pivot axis, the first and second sheaves are positioned with repsect to each other on the extension to locate the cable in a coplanar relationship with respect to the pivot axis;

means coupled between the winch drum and the moving means for controlling the rate at which the extension of the pivoting means moves across the width of the drum; and means carried on the pivoting means for counterweighting the extension of the pivoting means and the orientating means.

2. An apparatus according to claim 1 in which the ensuring means further includes a ball and socket assembly mounted in a split bracket on the extension of the pivoting means and being oriented for slidably engaging the drive pin through an axis of the ball and socket assembly to permit reciprocal motion by the pin and lateral pivotal motion by the pin coplanar with the axis of the first sheave.

3. An apparatus according to claim 2 in which the moving means includes a double diamond lead screw reaching across the width of the winch drum and a pawl engaging both the screw and the drive pin.

4. An apparatus according to claim 3 in which the controlling means is a timing belt reduction drive interconnection the axis of the winch drum and the double diamond lead screw of the moving means.

5. An apparatus according to claim 4 in which the pivoting means has an essentially triangularly shaped frame assembly mounting the first sheave on its apex and the second sheave mounted near the base both being coplanar with the pivot axis.

* * * * *